United States Patent [19]

Hasegawa et al.

[11] Patent Number: 4,526,144

[45] Date of Patent: Jul. 2, 1985

[54] IDLING RPM FEEDBACK CONTROL METHOD FOR INTERNAL COMBUSTION ENGINES

[75] Inventors: Shumpei Hasegawa, Niiza; Yuzi Makino, Mitaka, both of Japan

[73] Assignee: Honda Giken Kogyo K.K., Tokyo, Japan

[21] Appl. No.: 586,111

[22] Filed: Mar. 5, 1984

[30] Foreign Application Priority Data

Mar. 11, 1983 [JP] Japan ..... 58-40280

[51] Int. Cl.[3] ..... F02M 3/00

[52] U.S. Cl. ..... 123/339; 123/327; 123/585

[58] Field of Search ..... 123/339, 327, 480, 493, 123/585, 587

[56] References Cited

U.S. PATENT DOCUMENTS

| | | | |
|---|---|---|---|
| 4,203,395 | 5/1980 | Cromas et al. | 123/339 |
| 4,240,145 | 12/1980 | Yano et al. | 123/585 |
| 4,337,742 | 7/1982 | Carlson et al. | 123/339 |
| 4,378,766 | 4/1983 | Yamazoe et al. | 123/339 |
| 4,388,903 | 6/1983 | Yoshida et al. | 123/339 |
| 4,418,665 | 12/1983 | Nagase | 123/339 |
| 4,438,744 | 3/1984 | Hasegawa | 123/339 |
| 4,450,824 | 5/1984 | Ando et al. | 123/585 |

*Primary Examiner*—Parshotam S. Lall

*Attorney, Agent, or Firm*—Arthur L. Lessler

[57] ABSTRACT

A method of controlling a control valve that regulates the quantity of supplementary air being supplied to an internal combustion engine, in a feedback manner responsive to the difference between actual engine rpm and desired idling rpm at idling of the engine. During deceleration of the engine, the control valve is controlled so as to supply the engine with supplementary air at a volumetric flow rate dependent upon a detected value of ambient atmospheric pressure, after the engine has been determined to be in a predetermined operating condition and until the above feedback control is initiated. Preferably, the volumetric flow rate of the supplementary air quantity is set to larger values as the detected value of the atmospheric pressure decreases. The engine is determined to be in the above predetermined operating condition when at least one of conditions is satisfied that the actual engine rpm is smaller than a predetermined value larger than the desired idling rpm, and that the output shaft of the engine is not in engagement with a driven shaft driven by the engine.

6 Claims, 6 Drawing Figures

5
CPU
503
ROM
507
RAM
508
DRIVING CIRCUIT
509
DRIVING CIRCUIT
511
FUEL INJECTION VALVES
10
CONTROL VALVE
6
510
Me COUNTER
502
A/D CONVERTER
506
MULTI-PLEXER
505
DATA INPUT CIRCUIT
513
WAVEFORM SHAPER
501
LEVEL SHIFTER UNIT
504
LEVEL SHIFTER UNIT
512
RPM SENSOR
14
θTH SENSOR
17
PBA SENSOR
12
PA SENSOR
18
ELECTRICAL DEVICE SWITCHES
16
CLUTCH SWITCH
19

IDLING RPM FEEDBACK CONTROL METHOD FOR INTERNAL COMBUSTION ENGINES

BACKGROUND OF THE INVENTION

This invention relates to an idling rpm feedback control method for internal combustion engines, and more particularly to a method of this kind which is intended to prevent engine stall when the engine is operated in a low atmospheric pressure condition, such as at a high altitude.

In an internal combustion engine, the engine can easily stall due to a drop in the engine speed when the engine is operated in an idling condition at a low temperature of the engine cooling water or when the engine is heavily loaded with electrical loads by head lamps, an electric fan, etc. in a vehicle equipped with the engine. To eliminate such disadvantage, an idling rpm feedback control method has been proposed e.g. by Japanese Provisional Patent Publication (Kokai) No. 55-98628, which comprises setting desired idling rpm in dependence upon load on the engine, detecting the difference between the actual engine rpm and the desired idling rpm, and supplying supplementary air to the engine in a quantity corresponding to the detected difference so as to minimize the same difference, to thereby control the engine rpm to the desired idling rpm.

According to this proposed method, however, if the clutch or the transmission gear of the engine is disengaged while the engine is decelerating with the throttle valve fully closed, the engine speed can suddenly drop, depending upon the magnitude of load applied on the engine. Even if the above idling rpm feedback control is initiated immediately after such a sudden drop in the engine speed, it cannot promptly increase the supplementary air quantity at a rate sufficient to prevent a further drop in the engine speed, often causing engine stall. Even in the event that the engine is decelerated into the feedback-mode controlling region without the clutch or the transmission gear being disengaged during the deceleration, there can occur a delay in the supply of a quantity of supplementary air required for maintaining the engine speed at the desired idling rpm, also resulting in a drop in the engine speed to even cause engine stall depending upon the magnitude of the engine load, since only a quantity of supplementary air is supplied to the engine at the start of the feedback control, which just corresponds to the difference between the actual engine rpm and the desired idling rpm. In order to avoid this disadvantage, a method has been proposed by Japanese Provisional Patent Publication No. 55-1455, which comprises supplying a predetermined quantity of supplementary air to the engine in advance of initiation of the feedback control when the engine speed decreases below a predetermined value at deceleration of the engine, and a method has also been proposed by Japanese Provisional Patent Publication (Kokai) No. 55-98629, which comprises previously supplying the engine with supplementary air in such a manner that the supplementary air quantity is gradually increased as the engine speed decreases until it reaches a predetermined amount, for a period of time starting from the time the engine speed has decreased below a predetermined value at deceleration of the engine and until the feedback control is initiated.

However, when the engine is operated in a place where the ambient atmospheric pressure is low, such as at a high altitude, the mass flow of intake air supplied to the engine per one suction stroke of same is smaller than that when the engine is operated under standard atmosphere. As a consequence, if the engine is supplied with supplementary air at a volumetric flow rate set to a value appropriate to a standard atmospheric pressure condition, during deceleration under such a low atmospheric pressure, a shortage of the intake air will take place to cause a drop in the engine speed, and even engine stall depending upon the magnitude of the engine load. To avoid this disadvantage, the supplementary air should be supplied to the engine at an increased volumetric flow rate so as to make the mass flow of intake air supplied to the engine per one suction stroke under such a low atmospheric pressure equal to that under a standard atmospheric pressure.

SUMMARY OF THE INVENTION

It is the object of the invention to provide an idling rpm feedback control method which is capable of eliminating a delay in the feedback control of engine rpm at the start of the same control immediately following deceleration of the engine even when the engine is operated in a low atmospheric pressure condition, such as at a high altitude, to thereby ensure prevention of engine stall.

According to the invention, a method is provided for controlling a control valve for regulating the quantity of supplementary air being supplied to an internal combustion engine through an air passage, in a feedback manner responsive to the difference between actual engine rpm and desired idling rpm. The air passage communicates at one end with the intake passage of the engine at a location downstream of a throttle valve arranged therein and at the other end with the atmosphere. The method is characterized by comprising the steps of: (a) detecting a value of atmospheric pressure encompassing the engine; (b) determining whether or not the engine is operating in a predetermined operating condition while the engine is decelerating; (c) setting the volumetric flow rate of the supplementary air to be supplied to the engine to a value dependent upon the detected value of the atmospheric pressure, when it is determined at the step (b) that the engine is operating in the predetermined operating condition; and (d) controlling the control valve so as to supply the supplementary air to the engine at a volumetric flow rate corresponding to the value set at the step (c), after the engine has been determined to be in the predetermined operating condition and until the feedback control is initiated.

Preferably, in the above step (c), the volumetric flow rate of supplementary air is set to larger values as the detected value of the atmospheric pressure decreases. Also preferably, the control valve is controlled in the step (d) either in a manner such that the supplementary air is supplied to the engine at the volumetric flow rate corresponding to the value set at the step (c) in a continual manner all the time after the engine has been determined to be in the above predetermined operating condition and until the feedback control is initiated, or in a manner that the supplementary air is supplied to the engine at a volumetric flow rate gradually increasing as the rotational speed of the engine decreases, from the time the engine has been determined to be in the above predetermined operating condition until the volumetric flow rate reaches the value set at the step (c).

Further, the engine is preferably determined to be in the predetermined operating condition when at least one of conditions is satisfied that the actual value of engine rpm is smaller than a predetermined value which is larger than the value of the aforementioned desired idling rpm, and that the output shaft of the engine is determined not to be in engagement with a driven shaft driven by the engine.

The above and other objects, features and advantages of the invention will be more apparent from the ensuing detailed description taken in conjunction with the accompanying drawings.

DETAILED DESCRIPTION

The method of the invention will now be described in detail with reference to the drawings.

Figure 1:
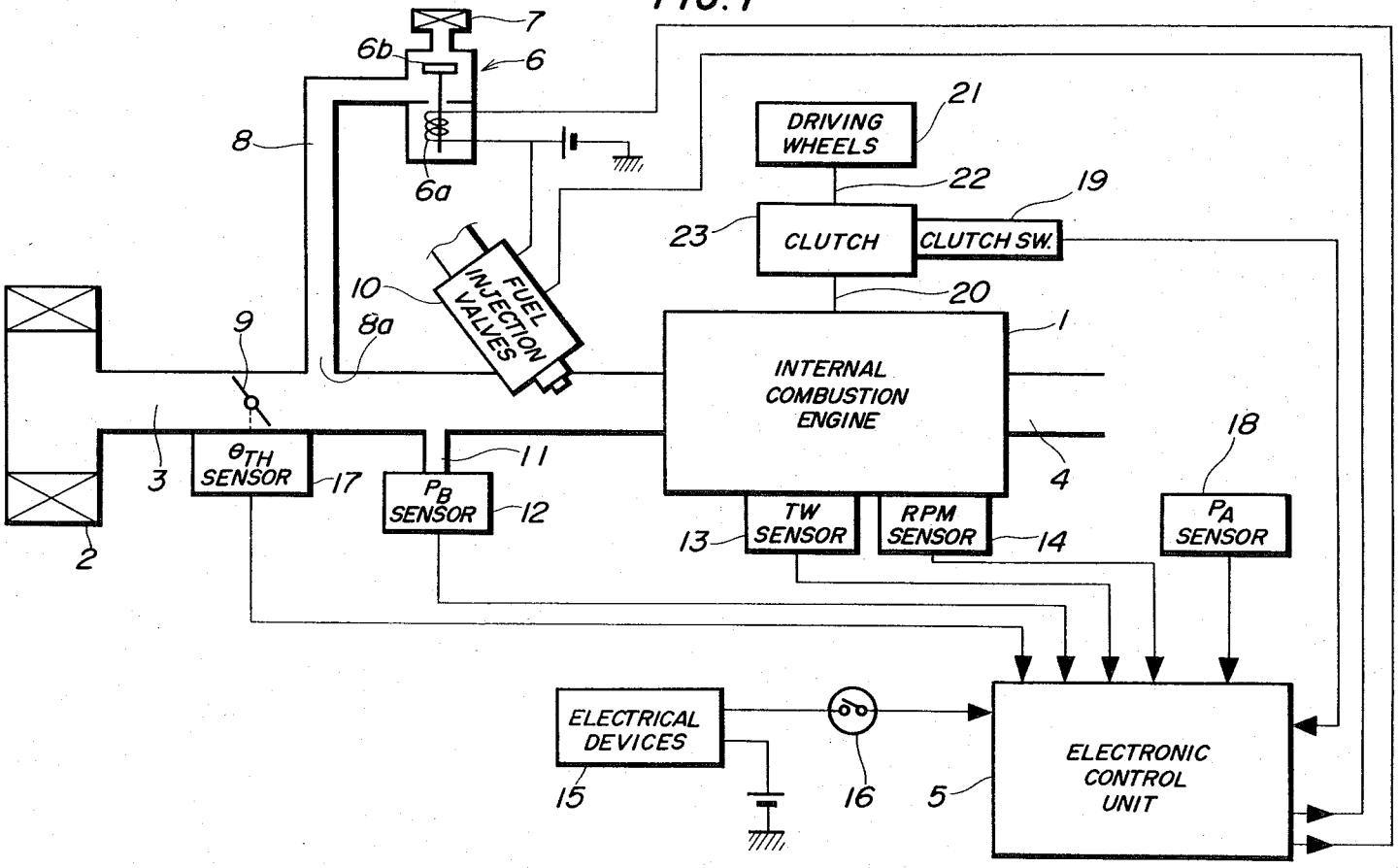
FIG. 1 is a block diagram illustrating the whole arrangement of an idling rpm feedback control system to which is applicable the method of the invention.

Referring first to FIG. 1, there is schematically illustrated the whole arrangement of an idling rpm feedback control system for internal combustion engines, to which is applicable the method of the invention. Reference numeral 1 designates an internal combustion engine which may be a four-cylinder type for instance, and to which are connected an intake pipe 3 with an air cleaner 2 mounted at its open end and an exhaust pipe 4, at an intake side and an exhaust side of the engine 1, respectively. A throttle valve 9 is arranged within the intake pipe 3, and an air passage 8 opens at its one end 8*a* in the intake pipe 3 at a location downstream of the throttle valve 9. The air passage 8 has its other end communicating with the atmosphere and provided with an air cleaner 7. A supplementary air quantity control valve (hereinafter called merely "the control valve") 6 is arranged across the air passage 8 to control the quantity of supplementary air being supplied to the engine 1 through the air passage 8. This control valve 6 is a normally closed type and comprises a solenoid 6*a* and a valve 6*b* disposed to open the air passage 8 when the solenoid 6*a* is energized. The solenoid 6*a* is electrically connected to an electronic control unit (hereinafter called "the ECU") 5. A fuel injection valve 10 is arranged in a manner projected into the intake pipe 3 at a location between the engine 1 and the open end 8*a* of the air passage 8, and is connected to a fuel pump, not shown, and also electrically connected to the ECU 5.

A throttle valve opening ($\theta$TH) sensor 17 is connected to the throttle valve 9, and an absolute pressure (PB) sensor 12 is provided in communication with the intake pipe 3 through a conduit 11 at a location downstream of the open end 8*a* of the air passage 8, while an engine cooling water temperature (TW) sensor 13 and an engine rotational angle position sensor (hereinafter called "the rpm sensor") 14 are both mounted on the body of the engine 1. All the sensors are electrically connected to the ECU 5.

Reference numeral 20 designates an output shaft of the engine 1, which is coupled through power transmission means 23 to a driven shaft 22 driven by the engine 1 and connected to driving wheels 21 of an automotive vehicle. The power transmission means 23 may be composed of a clutch or a transmission gear, or an automatic transmission if provided in the engine, and will hereinafter be referred to as "the clutch" throughout the specification for convenience's sake. A switch (hereinafter called "the clutch switch") 19 is mounted on the clutch 23 for detecting the state of engagement of same, and electrically connected to the ECU 5. Reference numeral 15 designates electrical devices such as head lamps and an electric fan, which are electrically connected to the ECU 5 by way of respective switches 16. An atmospheric pressure (PA) sensor 18 is also electrically connected to the ECU 5 for detecting atmospheric pressure encompassing the engine.

The idling rpm feedback control system constructed as above operates as follows: The ECU 5 is supplied with various engine operation parameter signals from the throttle valve opening ($\theta$TH) sensor 17, the absolute pressure (PB) sensor 12, the engine cooling water temperature TW sensor 13, the rpm sensor 14, and the atmospheric pressure (PA) sensor 18, as well as a signal indicative of the state of engagement of the clutch 23 from the clutch switch 19 and a signal indicative of electrical loads on the engine from the electrical devices 15. The ECU 5 determines operating conditions of the engine 1 from the read values of the above engine operation parameter signals, then calculates a desired quantity of fuel to be supplied to the engine 1, that is, a desired valve opening period of the fuel injection valves 10, which is appropriate to a determined operating condition of the engine, and supplies driving signals corresponding to the calculated value to the fuel injection valves 10 to drive them. The ECU 5 also determines a loaded condition of the engine from the above signal indicative of electrical loads on the engine, and supplies the control valve 6 with a driving signal corresponding to the determined loaded condition of the engine as well as to the above operating condition of the engine, to drive the control valve 6, as hereinafter described in detail.

The control valve 6 has its solenoid 6*a* energized by each pulse of the driving signal which is supplied from the ECU 5 each time a pulse of a top dead center-position (TDC) signal generated by the rpm sensor 14 is applied to the ECU 5, to open its valve body 6*b* for a period of time corresponding to the pulse duration of the driving pulse, thereby opening the air passage 8 to supply the engine 1 with supplementary air at a volumetric flow rate corresponding to the calculated valve opening period, i.e. valve opening duty ratio relative to the interval of time between two adjacent pulses of the TDC signal, through the air passage 8 and the intake pipe 3.

The fuel injection valves 10 are energized by its driving pulses to open for a period of time corresponding to its calculated valve opening period value to inject fuel into the intake pipe 3, so as to supply an air/fuel mixture having a desired air/fuel ratio to the engine 1.

When the valve opening period, i.e. valve opening duty ratio, of the control valve 6 is increased to increase the volumetric flow rate of supplementary air, the mass flow of the mixture supplied to the engine 1 increases to increase the engine output, resulting in an increase in the engine speed, whereas a decrease in the above valve opening period or duty ratio causes a corresponding decrease in the volumetric flow rate of the mixture, resulting in a decrease in the engine speed. In this manner, the engine speed is controlled by controlling the volumetric flow rate of supplementary air or the valve opening duty ratio of the control valve 6.

Figure 2:
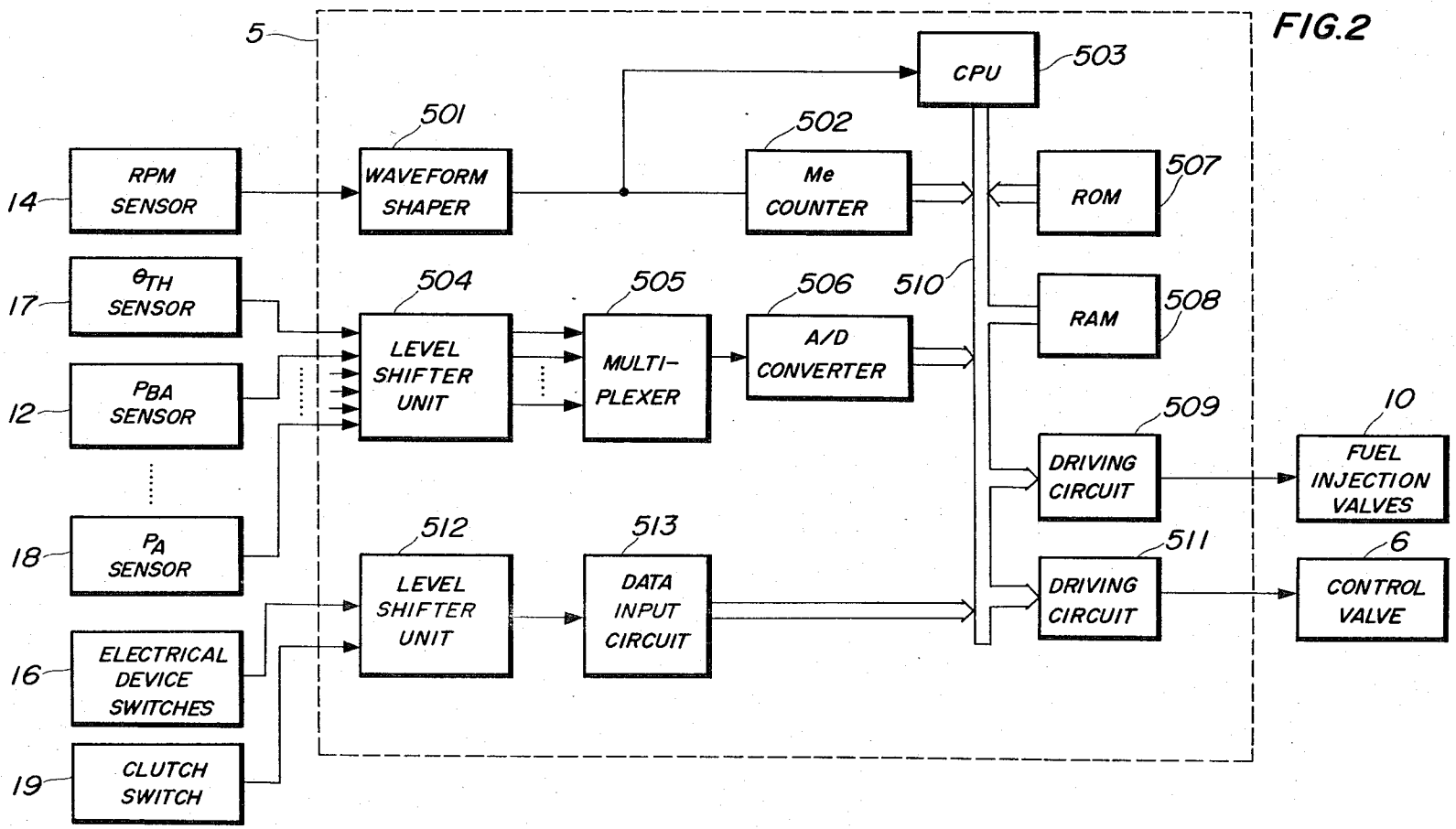
FIG. 2 is a circuit diagram showing the internal arrangement of an electronic control unit (ECU) in FIG. 1.

FIG. 2 shows a circuit configuration within the ECU 5 in FIG. 1. An output signal from the rpm sensor 14 in FIG. 1 is applied to a waveform shaper 501, wherein it has its pulse waveform shaped, and supplied to a central processing unit (hereinafter called "the CPU") 503 as the TDC signal, as well as to an Me value counter 502. The Me value counter 502 counts the interval of time between a preceding pulse of the TDC signal and a present pulse of the same signal, inputted thereto from the rpm sensor 14, and therefore its counted value Me is proportional to the reciprocal of the actual engine rotational speed Ne. The Me value counter 502 supplies the counted value Me to the CPU 503 via a data bus 510.

The respective output signals from the throttle valve opening ($\theta$TH) sensor 17, the intake pipe absolute pressure (PB) sensor 12, the atmospheric pressure (PA) sensor 18, etc. have their voltage levels shifted to a predetermined voltage level by a level shifter unit 504 and successively applied to an analog-to-digital converter 506 through a multiplexer 505. The analog-to-digital converter 506 successively converts into digital signals analog output voltages from the aforementioned various sensors, and the resulting digital signals are supplied to the CPU 503 via the data bus 510.

Signals from the switches 16 of the electrical devices 15 and from the clutch switch 19 in FIG. 1, indicative of the respective on and off positions of same have their voltage levels shifted to a predetermined level by another level shifter 512, then converted into a predetermined signal by a data input circuit 513 and supplied to the CPU 503 via the data bus 510.

Further connected to the CPU 503 via the data bus 510 are a read-only memory (hereinafter called "the ROM") 507, a random access memory (hereinafter called "the RAM") 508 and driving circuits 509 and 511. The RAM 508 temporarily stores various calculated values from the CPU 503, while the ROM 507 stores a control program executed within the CPU 503, etc.

The CPU 503 executes the control program stored in the ROM 507 in response to the values of the aforementioned various engine operation parameter signals to determine operating conditions of the engine and loaded conditions of same for supplying an on-off control signal to the driving circuit 511 for control of the control valve 6, and calculate the fuel injection period TOUT for the fuel injection valves 10 to supply the calculated value of fuel injection period to the driving circuit 509 via the data bus 510. The driving circuit 509 is responsive to this calculated value to supply driving signals to the fuel injection valve 10 to drive same. On the other hand, the driving circuit 511 supplies the driving signal to the control valve 6 to drive same.

Figure 3:
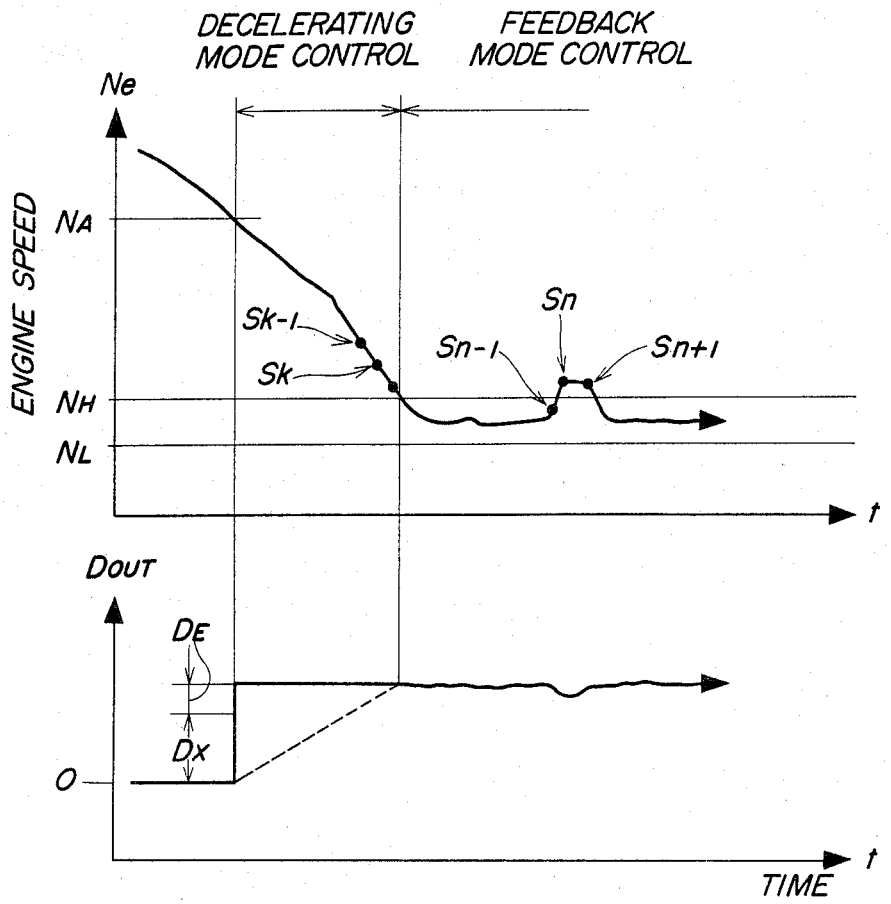
FIG. 3 is a timing chart showing the method of the invention.

Details of the idling rpm control operation of the idling rpm feedback control system constructed as above will now be described with reference to FIGS. 1 and 2 previously referred to and FIGS. 3 through 5. As shown in FIG. 3, according to the invention, when the throttle valve 9 is fully closed to decelerate the engine so that the engine speed decreases with a lapse of time to a predetermined rpm NA (e.g. 1500 rpm), the control valve 6 is opened to allow supply of the supplementary air to the engine 1 through the air passage 8 to initiate control of the supplementary air quantity in decelerating mode, in a manner as hereinafter described. When the engine speed further decreases below an upper limit NH of a desired idling rpm range, the supplementary air quantity is controlled in feedback mode so as to maintain the engine rotational speed Ne between the upper limit NH and a lower limit NL of the desired idling rpm range. These upper and lower limits of the desired idling rpm range are provided for stable control of the idling rpm. They are set at values higher and lower by a predetermined rpm value (e.g. 30 rpm) than a central value of a desired idling rpm range which is set to a value appropriate to the engine operation in dependence upon engine cooling water temperature, engine loads applied e.g. by the electrical devices 15, etc. each time there occurs a change in any of these parameters. When the actual engine speed lies between the upper limit NH and the lower limit NL, the ECU 5 regards that the engine rpm is equal to the desired idling rpm.

Upon the engine speed Ne dropping below the predetermined rpm NA, the aforementioned decelerating mode control is initiated to supply the engine with supplementary air at a volumetric flow rate corresponding to the valve opening duty ratio DOUT of the control valve 6. The valve opening duty ratio DOUT is set to a value which is the sum of an electrical load term DE determined in dependence on the magnitude of load applied on the engine by the electrical devices 15, and a term DX variable as a function of ambient atmospheric pressure.

Figure 4:
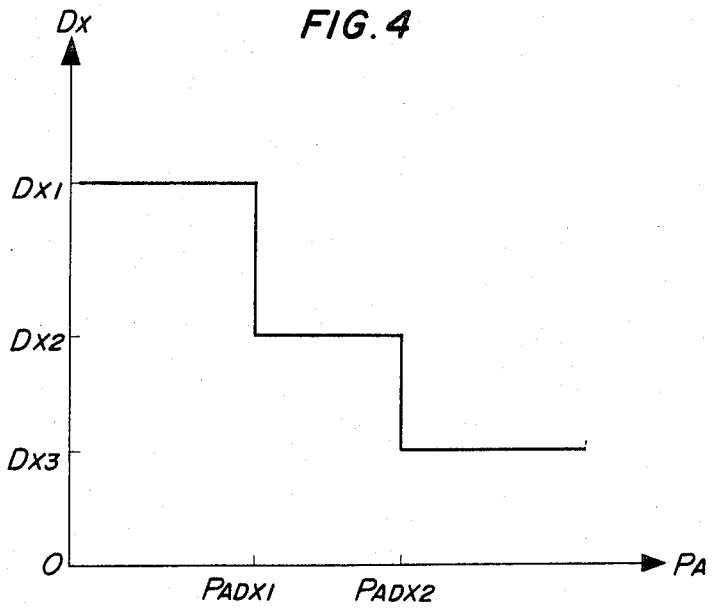
FIG. 4 is a graph showing, by way of example, the relationship between the valve opening duty ratio DX of a supplementary air quantity control valve and the atmospheric pressure PA, which is applied during control of the engine rpm in decelerating mode.

FIG. 4 shows an example of the relationship between the above term DX and the atmospheric pressure PA. As shown in the figure, two predetermined values PADX1 (e.g. 600 mmHg) and PADX2 (e.g. 700 mmHg) of atmospheric pressure PA are provided to determine three ranges, that is, a first range ($PA \leqq PADX1$), a second range ($PADX1 < PA < PADX2$), and a third range ($PA \geqq PADX2$). The term DX has its value set to larger values as the atmospheric pressure PA decreases such that even with a decrease in the atmospheric pressure, the mass flow of intake air supplied to the engine is maintained at a value substantially equal to that under a standard atmospheric pressure. For example, the same term DX is set to one of three constant values DX1 (e.g. 50%), DX2 (e.g. 30%) and DX3 (e.g. 10%) to be applied, respectively, to the first, second and third ranges of atmospheric pressure PA, in response to the atmospheric pressure PA. These values DX1, DX2 and DX3 are stored in the ROM 507. Accordingly, when the engine is operated in a place where the atmospheric pressure PA is low, such as at a high altitude, the term DX, i.e. the valve opening duty ratio DOUT of the control valve 6, is set to a larger value to thereby increase the volumetric flow rate of supplementary air being supplied to the engine. Although in the FIG. 4 example, the term DX has its value so varied in a stepwise manner with a change in the atmospheric pressure PA, alternatively the same term DX may be so set as to vary in a stepless or continuous manner along a straight line or a curve with a change in the atmospheric pressure PA. Further, the term DX may be determined through calculation as a function of the atmospheric pressure PA, by the use of a predetermined equation.

In this manner, according to the invention, while the engine is decelerating with the throttle valve fully closed, the supplementary air is supplied to the engine at a volumetric flow rate dependent on the atmospheric pressure, upon the engine speed Ne dropping below the predetermined rpm NA. Therefore, engine stall can be avoided even if the clutch is disengaged during deceleration of the engine, particularly when the engine is operated in a low atmospheric pressure condition, such as at a high altitude.

On the other hand, the idling rpm feedback control is carried out as follows: The ECU 5 detects the difference between the upper or lower limit NH or NL of the desired idling rpm range set to a value depending upon engine load as previously mentioned, and the actual engine speed Ne obtained by the rpm sensor 14, sets the valve opening duty ratio of the control valve 6 to such a value as corresponds to the detected difference and makes the same difference zero, and opens the control valve 6 for a period of time corresponding to the set valve opening duty ratio to control the volumetric flow rate of supplementary air, thereby controlling the engine speed to a value between the upper and lower limits NH and NL, i.e. the desired engine rpm.

During the above feedback control of the supplementary air quantity at engine idle, the engine speed Ne can temporarily rise above the upper desired rpm limit NH, due to external disturbances or extinction of the engine load caused by switching-off of the electrical devices 15, as indicated by the symbol Sn in FIG. 3. In such event, the ECU 5 determines whether or not control of the supplementary air quantity in the preceding loop was effected in feedback mode. This determination is provided to ensure continuation of the idling rpm feedback control without being affected by disturbances in the engine speed caused by external disturbances, etc. once the same feedback control has been initiated. In the example of FIG. 3, it is noted that the preceding loop Sn−1 was in feedback mode. Therefore, the feedback control is continued also in the present loop Sn. Further, in the FIG. 3 example, it will be also determined by the ECU 5 that the present loop Sn is in feedback mode if the engine speed still exceeds the upper limit NH in the next loop Sn+1 as in the same example, and the feedback control will be continued also in the next loop. In this manner, once the feedback control has been started immediately after termination of the decelerating control, the same feedback control is continuously effected so long as the throttle valve 9 is kept fully closed, even if the engine speed temporarily rises above the upper limit NH due to external disturbances, etc. to thereby achieve stable idling rpm feedback control.

On the other hand, during the control in decelerating mode, so long as the engine speed Ne remains above the upper limit NH as indicated by the symbol Sk in FIG. 3, the ECU 5 determines whether or not the preceding loop Sk−1 was in decelerating mode, and continues the decelerating control also in the present loop Sk if the preceding loop was in decelerating mode. This makes it possible to avoid that the ECU 5 wrongly judges that the engine is in a feedback-mode controlling region, though in fact the engine is still in a decelerating-mode controlling region with the engine speed above the upper idling rpm limit NH, and also avoid that the valve opening duty ratio of the control valve 6 is controlled to an extremely small value when the feedback control is erroneously carried out due to the above misjudgement, causing engine stall upon disengagement of the clutch.

Figure 5:
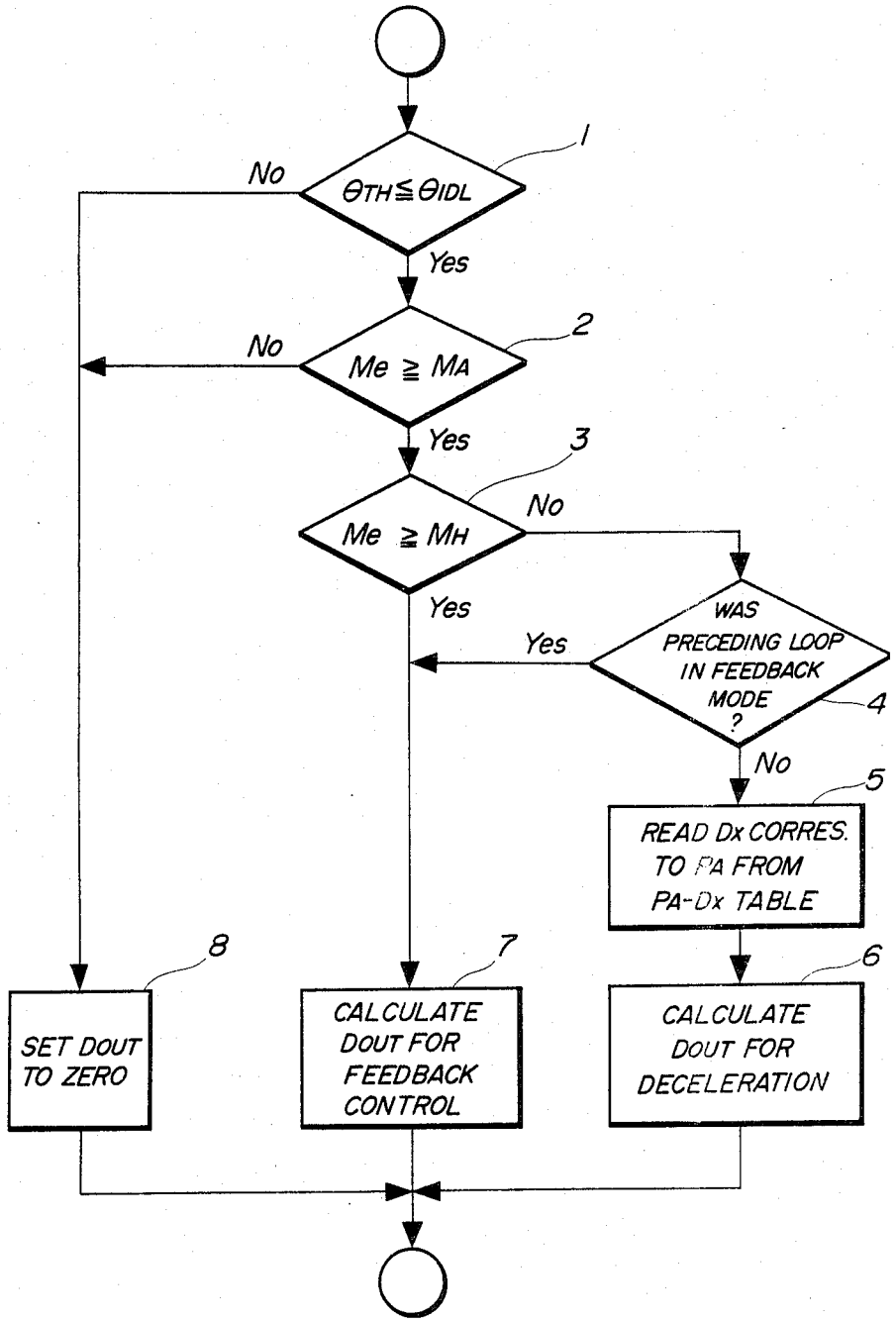
FIG. 5 is a flow chart of a program for carrying out the method of the invention, which is executed within the ECU.

FIG. 5 is a flow chart showing a routine of the control program for executing the above described control of the supplementary air quantity in decelerating mode and in feedback mode for control of the idling rpm of the engine, which is executed within the ECU 5. This routine is executed in synchronism with a pulse signal or TDC signal having each pulse generated at a predetermined crank angle of the engine 1 or a pulse signal having its pulses generated at constant time intervals. First, a determination is made as to whether or not the engine is in an operating condition requiring the supply of supplementary air to the engine, at the steps 1 and 2. To be concrete, at the step 1, it is determined whether or not a detected value of the throttle valve opening is smaller than a predetermined value $\theta$IDL corresponding to a substantially fully closed position of the throttle valve. Then, a determination is made at the step 2 as to whether or not the aforementioned counted value Me, which is proportional to the reciprocal of the engine speed Ne, is larger than a predetermined value MA which corresponds to the reciprocal of a predetermined rpm value NA (e.g. 1500 rpm). If either of the answers to the determinations at the steps 1 and 2 is negative or no, that is, when the throttle valve is in an open position or the engine speed Ne is larger than the predetermined rpm value NA, the valve opening duty ratio DOUT of the control valve 6 is set to zero, at the step 8, followed by termination of execution of the present program, since the supply of supplementary air to the engine is then unnecessary because there is no fear of engine stall or vibrations of the engine which can occur when the engine rotational speed is low.

If the answers to the questions of the steps 1 and 2 are both yes, that is, when the throttle valve is in a substantially fully closed position and at the same time the engine speed Ne is decreased below the predetermined rpm value NA, the program proceeds to the step 3, where comparison is made between the value Me proportional to the reciprocal of the engine speed Ne and a value MH corresponding to the reciprocal of the upper limit NH of the desired idling rpm range. When the relationship of Me≧MH does not stand, that is, the engine speed Ne is larger than the upper limit NH, it is determined at the step 4 whether or not the preceding loop was in feedback mode. If the answer is negative or no, the ECU 5 regards that the present loop should be in decelerating mode. Accordingly, the ECU 5 reads a value of the aforementioned term DX corresponding to the actual value of atmospheric pressure PA from the PA-DX table of FIG. 4, at the step 5, and then calculates the valve opening duty ratio DOUT of the control valve 6 for the decelerating mode control by adding the read value DX to the aforementioned electrical load term DE, at the step 6.

When the relationship of Me≧MH stands at the step 3, that is, the engine speed Ne becomes smaller than the upper limit NH of the desired idling rpm range, the program proceeds from the control in decelerating mode to the idling rpm control in feedback mode, where the valve opening duty ratio DOUT is calculated for application in the feedback control in the aforedescribed manner, at the step 7. If the answer to the question of the step 4 is affirmative, that is, when the engine speed Ne is larger than the upper desired rpm limit NH and at the same time the preceding loop was in feedback mode, the program also proceeds to the step 7 to continue the feedback control.

According to the above-described embodiment, the supplementary air is supplied to the engine at a predetermined volumetric flow rate dependent on the atmospheric pressure PA in a continual manner all the time immediately after the engine speed Ne has decreased below the predetermined rpm NA by the decelerating mode control and until the engine idling rpm feedback control is initiated. However, the manner of supplying the supplementary air in decelerating mode is not limited to the above one. Alternatively of the above embodiment, after the engine speed Ne has decreased below the predetermined rpm value NA, the valve opening duty ratio DOUT of the control valve 6 may be calculated by the use of the following equation, at the step 6 in FIG. 5, in such a manner that it is gradually increased as the rotational speed of the engine decreases, so as to become equal to the sum of values of the electrical load term DE and the aforementioned term DX which is dependent upon the atmospheric pressure by the time the feedback mode control is initiated, as indicated by the broken line in FIG. 3:

$$DOUT=(DX+DE)/(MH-MA)\times(Me-MA)$$

Figure 6:
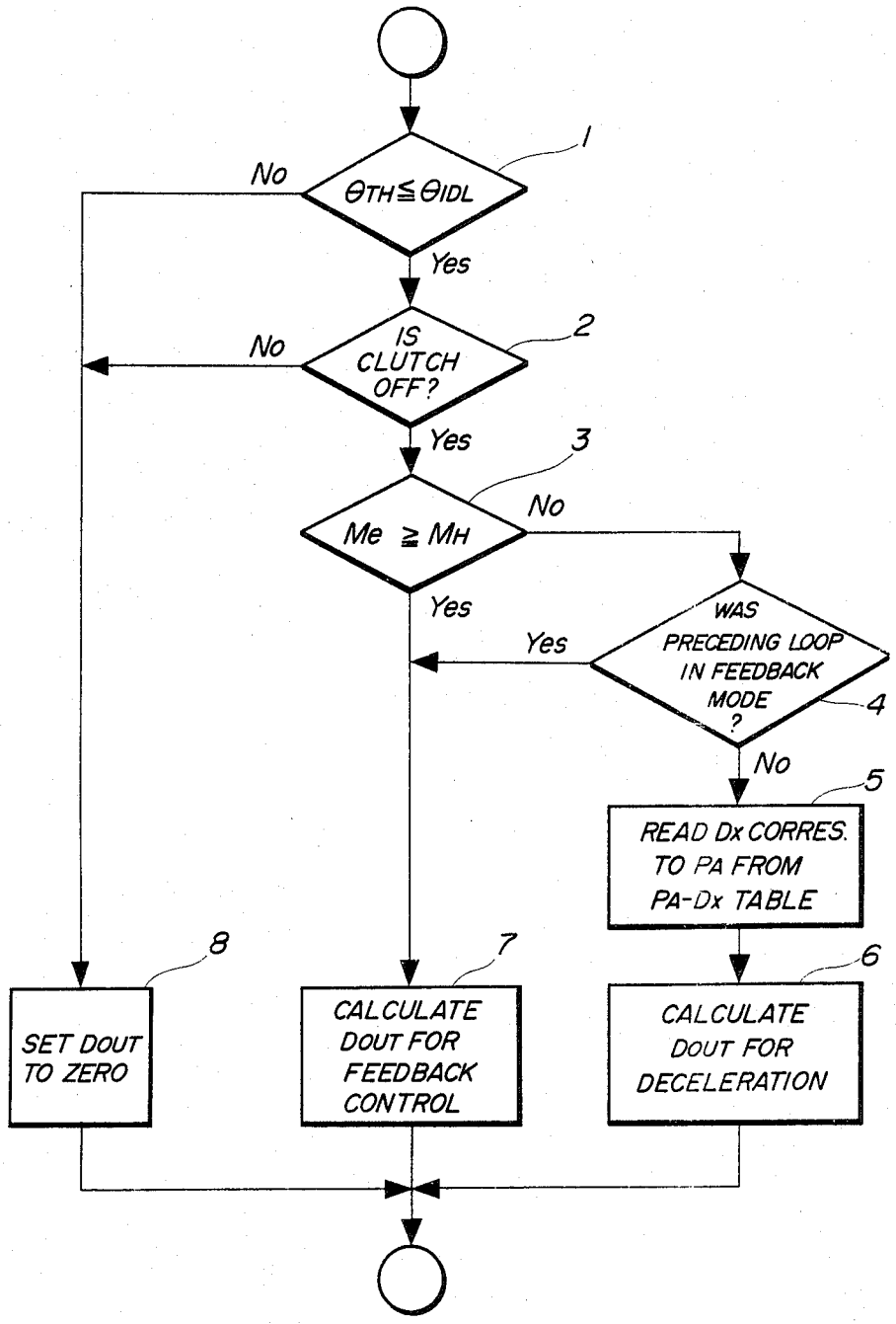
FIG. 6 is a flow chart of another example of the program for carrying out the method of the invention.

FIG. 6 shows a flow chart of another example of the program for carrying out the method of the invention, wherein all the steps in FIG. 6 are substantially identical with the corresponding steps in the flow chart of FIG. 5, except the step 2. In the step 2 in FIG. 6, whether or not the clutch 23 is in a disengaged state is determined from the aforementioned signal indicative of the state of engagement of the clutch 23 supplied from the clutch switch 19 in FIG. 1. When it is determined for the first time at the steps 1 and 2 that the throttle valve 9 is in a substantially closed position and at the same time the clutch 23 is in a disengaged state, control of the supplementary air quantity is effected in decelerating mode, and thereafter the steps 3 through 7 are repeatedly executed so long as the answers to the questions of the steps 1 and 2 are both yes, in the same manner as described before with reference to FIG. 5.

What is claimed is:

1. A method of controlling a control valve for regulating the quantity of supplementary air being supplied to an internal combustion engine, in a feedback manner responsive to the difference between actual engine rpm and desired idling rpm, said engine having an intake passage, a throttle valve arranged in said intake passage, and an air passage having one end communicating with said intake passage at a location downstream of said throttle valve and another end communicating with the atmosphere, respectively, said supplementary air being supplied to said engine through said air pressure and said intake passage, said method comprising the steps of:

(a) detecting a value of atmospheric pressure encompassing said engine;

(b) determining whether or not said engine is in a predetermined operating condition while said engine is decelerating immediately before entering a region where said feedback control is to be executed;

(c) setting the volumetric flow rate of said supplementary air to be supplied to said engine to a value dependent upon the detected value of said atmospheric pressure when it is determined at said step (b) that said engine is operating in said predetermined operating condition; and (d) controlling said control valve so as to supply said supplementary air to said engine at a volumetric flow rate corresponding to the value set at said step (c), after said engine has been determined to be in said predetermined operating condition and until said feedback control is initiated, to thereby stabilize the engine rpm immediately after said feedback control has been initiated.

2. A method as claimed in claim 1, wherein said step (c) comprises setting the volumetric flow rate of said supplementary air to larger values as the detected value of said atmospheric pressure decreases.

3. A method as claimed in claim 1, wherein said step (d) comprises controlling said control valve so as to supply said supplementary air to said engine at said volumetric flow rate corresponding to the value set at said step (c) in a continual manner all the time after said engine has been determined to be in said predetermined operating condition and until said feedback control is initiated.

4. A method as claimed in claim 1, wherein said step (d) comprises controlling said control valve so as to supply said supplementary air to said engine at a volumetric flow rate gradually increasing as the rotational speed of said engine decreases from the time said engine has been determined to be in said predetermined operating condition until the volumetric flow rate reaches the value set at said step (c).

5. A method as claimed in claim 1, including the step of detecting the rotational speed of said engine, wherein said engine is determined to be in said predetermined operating condition when the detected value of the rotational speed of said engine is lower than a predetermined value which is larger than the value of said desired idling rpm.

6. A method as claimed in claim 1, including the step of determining whether or not said engine has an output shaft thereof in engagement with a driven shaft driven by said engine, wherein said engine is determined to be in said predetermined operating condition when said output shaft of said engine is not in engagement with said driven shaft.

* * * * *

UNITED STATES PATENT AND TRADEMARK OFFICE

CERTIFICATE OF CORRECTION

PATENT NO. : 4,526,144

DATED : July 2, 1985

INVENTOR(S) : Shumpei Hasegawa, Yuzi Makino

It is certified that error appears in the above-identified patent and that said Letters Patent is hereby corrected as shown below:

Claim 1, column 9, line 55: change "pressure" to read "passage".

Signed and Sealed this

*Nineteenth* Day of *November 1985*

[SEAL]

*Attest:*

DONALD J. QUIGG

*Attesting Officer*

*Commissioner of Patents and Trademarks*